US005692565A

United States Patent [19]

MacDougall et al.

[11] Patent Number: 5,692,565

[45] Date of Patent: Dec. 2, 1997

[54] APPARATUS AND METHOD FOR SAMPLING AN EARTH FORMATION THROUGH A CASED BOREHOLE

[75] Inventors: Thomas D. MacDougall; Andrew L. Kurkjian, both of Sugar Land; Miles Jaroska, Richmond; Aaron G. Flores; Duane F. LaDue, both of Sugar Land, all of Tex.

[73] Assignee: Schlumberger Technology Corporation, Houston, Tex.

[21] Appl. No.: 603,306

[22] Filed: Feb. 20, 1996

[51] Int. Cl.[6] ..... E21B 43/112; E21B 49/10

[52] U.S. Cl. ..... 166/264; 73/152.26; 166/55.1; 166/298

[58] Field of Search ..... 166/50, 100, 55, 166/55.1, 55.2, 250.16, 250.17, 264, 277, 297, 298, 242.2; 175/58, 59, 61, 62; 73/152.23, 152.24, 152.26

[56] References Cited

U.S. PATENT DOCUMENTS

| | | | |
|---|---|---|---|
| 3,456,504 | 7/1969 | Bombardieri | 166/264 X |
| 4,369,654 | 1/1983 | Hallmark | 73/152.26 |
| 4,658,916 | 4/1987 | Bond | 175/81 |
| 5,195,588 | 3/1993 | Dave | 166/264 |
| 5,413,184 | 5/1995 | Landers | 175/62 |

FOREIGN PATENT DOCUMENTS

| | | | |
|---|---|---|---|
| 720141 | 3/1980 | U.S.S.R. | 166/298 |

*Primary Examiner*—David J. Bagnell
*Attorney, Agent, or Firm*—Brigitte L. Jeffery; John J. Ryberg

[57] ABSTRACT

An apparatus is disclosed for perforating, testing and resealing casing in an earth formation borehole. The apparatus is moveable through the casing. The apparatus can also be mounted on a wireline, on tubing or on both. A perforating device is mounted in the apparatus for producing a perforation in the casing. The perforating device contains a flexible drilling shaft that enables the drilling of perforations in the casing of lengths greater than the diameter of the borehole. The apparatus will usually contain components for hydraulic testing and sampling from the formation behind the casing. Also mounted in the apparatus is a device for plugging and resealing the perforation with a solid plug.

28 Claims, 5 Drawing Sheets

FIG. 6a
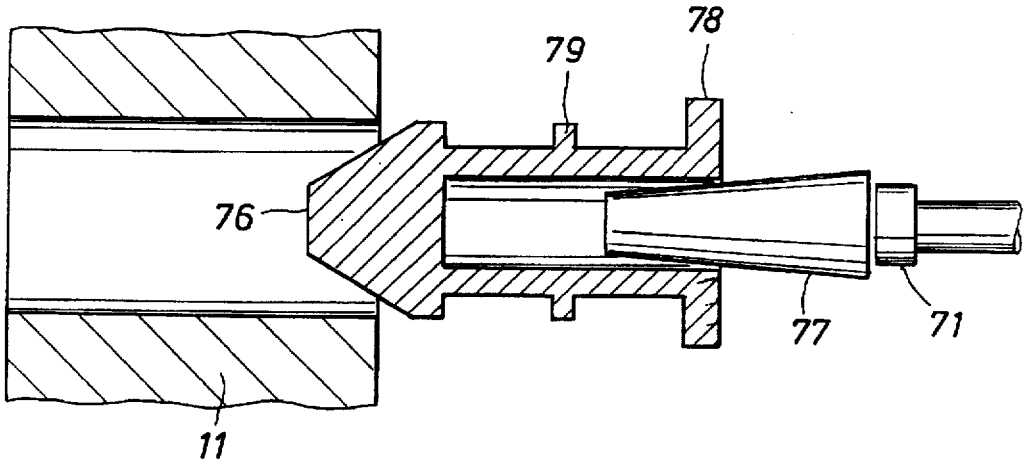
FIG. 6b
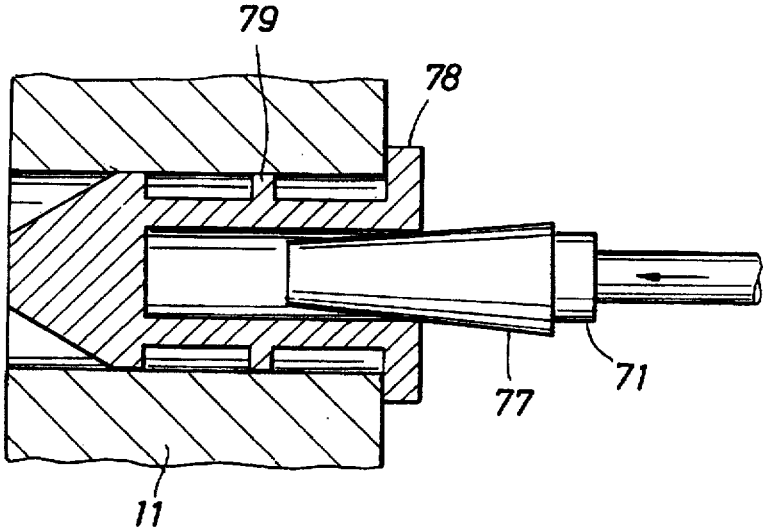
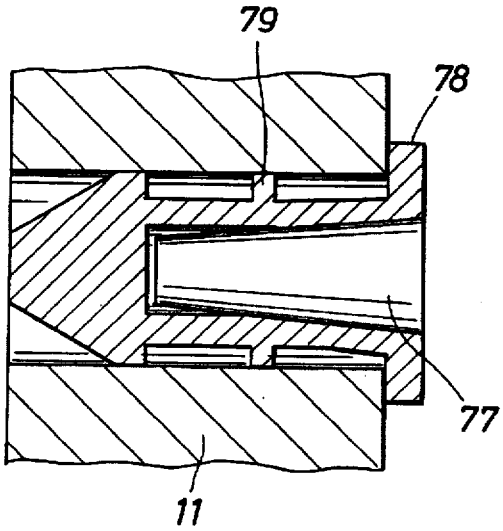
FIG. 6c

APPARATUS AND METHOD FOR SAMPLING AN EARTH FORMATION THROUGH A CASED BOREHOLE

FIELD OF THE INVENTION

This invention relates to the field of investigating formations surrounding earth boreholes. More particularly, this invention relates to perforating a cased borehole, measuring the pressure, sampling fluids in the earth formation surrounding the cased borehole and resealing of perforations in the casing.

BACKGROUND OF THE INVENTION

Although there exists an ever increasing demand to find oil and gas reserves, there are approximately 200 wells considered for abandonment each year in North America which adds to the thousands of wells that are already idle. These abandoned wells have been determined to no longer produce oil and gas in necessary quantities to be economically profitable. However, the majority of these wells were drilled in the late 1960's and 1970's and logged using techniques that are primitive by today's standards. Thus, recent research has uncovered evidence that many of these abandoned wells contain large amounts of recoverable natural gas and oil (perhaps as much as 100 to 200 trillion cubic feet) that have been missed by conventional production techniques. Because the majority of the field development costs such as drilling, casing and cementing have already been incurred for these wells, the exploitation of these wells to produce oil and natural gas resources could prove to be an inexpensive venture that would increase production of hydrocarbons and gas.

In well logging, to determine whether there are retrievable resources, the most important parameter that a reservoir engineer uses to manage a well is downhole pressure. Normally, a borehole is logged (pressure measurements and fluid samples) immediately after drilling (open hole) to locate primary and secondary pay zones. However, in the drilling and/or producing of an earth formation borehole steel casing may be routinely used in one or more sections of the borehole to stabilize and provide support for the formation surrounding the borehole. Cement is also employed on the outside of the casing to hold the casing in place and to provide a degree of structural integrity and a seal between the formation and the casing.

There are various circumstances in which it is necessary or desirable to make one or more perforations through the casing and cement in order to retrieve resources from the formation and to perform tests behind the casing and through the surrounding cement, if present. For example, a commercially used technique employs a tool which can be lowered on a wireline to a cased section of a borehole, the tool including a shaped explosive charge for perforating the casing, and testing and sampling devices for measuring hydraulic parameters of the environment behind the casing and/or for taking samples of fluids from said environment.

During the production of a well and after the primary pay zone is depleted, a series of shaped-charge explosives are lowered into the well and the casing at the secondary zone is perforated. Currently, this perforation technique is also used to gain pressure and porosity information during exploration behind casing in older wells. However, if the zone does not posses hydrocarbons or sufficient pressure, the perforation holes must be sealed to prevent crossflow between layers of fluids.

In addition, based on results of testing after through perforations in casing, sometimes a decision is made whether to perforate the well for production or to abandon and plug or reseal the zone. The term "plugging" traditionally means plugging an entire cross section of the well. Perforations can be plugged with cement through drill pipes. Elastomeric plugging is also used to plug an entire well by isolating the zone below the plug during or after the production. Elastomeric plugs are also used as an anchor for setting cement. Well treatment and plugging can also be done with coiled tubing. Plugging a perforation to prevent crossflow between layers of fluids involves using an explosive, difficult and time-consuming process called a "squeeze job" which consists of isolating the perforated zone and squeezing cement into the perforations.

A drawback of using a tool that perforates casing for testing is that the perforation which remains in the casing can cause problems in instances where production or zone plugging does not quickly follow. In some fortunate instances the perforation may become clogged with debris from the borehole and rendered essentially harmless if the debris permanently plugs the perforation. However, if the perforation, or part of it, remains open, a substantial volume of formation fluids may be lost into the formations and/or may degrade the formation. In some situations, fluids from the formations may enter the borehole with deleterious effect. Gas intrusion into the borehole can be particularly problematic.

Not only are there problems plugging a perforation in casing, there can be problems in the actual perforating of the casing. One major problem with perforating the casing is that current perforating means include shape-charge explosives. The use of these explosives usually produce non-uniform perforations in the casing. Therefore, these perforations are difficult to plug and often require use of a solid plug and a non-solid sealant material. This requirement increases the complexity and time required to adequately plug a perforation in the casing.

An example of the present technology and sampling configuration is shown in U.S. Pat. No. 5,195,588 (Dave). In this patent, an apparatus is disclosed that plugs a perforation in the casing. The method of sampling reveals the above-described limitation for sampling at extended depths into the earth formation. Dave describes a perforating technique that incorporates a shaped-charge to create a perforation in the casing. Although the Dave patent mentions perforating and sampling in a cased hole, there is virtually no discussion in Dave about techniques that create more uniform perforations or about techniques that extend the depth of sampling into the formation. In addition, although the Dave patent is similar to the present invention, Dave's objectives are concerned with developing techniques to be used in plugging an already existing perforation in the casing. Therefore, there still remains a need to create more uniform perforations and to extend sampling capabilities greater depths of investigation into the formation.

It is among the objects of the present invention to address the problems of perforating and testing in cased sections of an earth borehole, and to design an apparatus and method which solves the problem in a practical way.

SUMMARY OF THE INVENTION

It is an object of the invention to create more uniform perforations in casing of a borehole.

It is an object of this invention to create perforations with lengths greater than the diameter of the borehole.

It is another object of this invention to measure pressure and sample formation fluids through borehole casing.

It is another object of this invention to plug and reseal borehole casing perforations.

In accordance with a form of the present invention, there is provided an apparatus and method for perforating and resealing casing in an earth borehole. The apparatus also has the capability to sample and test the earth formation fluids. The apparatus is moveable through the casing and can be mounted on a wireline, on tubing, or on both. Mounted inside the apparatus is a perforating means for creating a perforation through the casing and into the borehole. The plugging means is also mounted inside the device for plugging the perforation. A plurality of plugs can be stored in the apparatus to permit the plugging of several perforations during one tool run in the borehole. The apparatus will also generally include means for testing/sampling (that is, testing for hydraulic properties such as pressure or flow rate, and/or sampling fluids) of the fluids of formations behind the casing.

In an embodiment of the invention, the perforating means comprises a flexible shaft to be used to drill a perforation through the casing and formation. The flexibility of the flexible shaft permits drilling a perforation into the formation at lengths greater than the diameter of the borehole and thereby enables the sampling at formation depths greater than the borehole diameter. Plugging means are also mounted in the device for plugging the perforation. In an embodiment of the invention, the means for plugging the perforation comprises means for inserting a plug of a solid material into the perforation.

To secure the apparatus in the borehole, this invention also has a means for setting said device at a substantially fixed location. The invention also has the capability of actuating the perforating means and the plugging means while the device is set at a substantially fixed location. Also this embodiment can have a means for moving the perforating means to a desired position in the borehole. There is also a means for moving the plugging means to a position opposite the perforation in the casing.

Although this invention contains some known features, there are several advantages to the present invention over the existing technology. First, this invention uses non-explosive perforating means to perforate the casing that create a more uniform perforation which can be easily plugged and without the need to use of non-solid plugging means. Another advantage is the ability to extend the perforation to lengths in the formation that are greater than the diameter of the borehole. A major advantage of the present invention is that it can be implemented with a wireline device and does not require tubing, although tubing can be used if desired. Another result of this advantage is more flexibility in aligning a motor and power devices. A further advantage of a form of the present invention is that a perforation can be plugged while the tool is still set in the position at which the perforation was made, so the plugging operation can be specifically and accurately directed to the perforation, without the need for locating the perforation or for wasting the plugging medium by plugging a region that is larger than the perforation itself.

Further features and advantages of the invention will become more readily apparent from the following detailed description when taken in conjunction with the accompanying drawings.

BRIEF DESCRIPTION OF THE DRAWINGS

FIG. 6*a* is side view of the components of a plugging assembly.

FIG. 6*b* is side view of the components of a plugging assembly during the plugging operation.

FIG. 6*c* is a side view of a plug hole in the casing using the plugging assembly of the present invention.

DESCRIPTION OF THE PREFERRED EMBODIMENT

Figure 1:
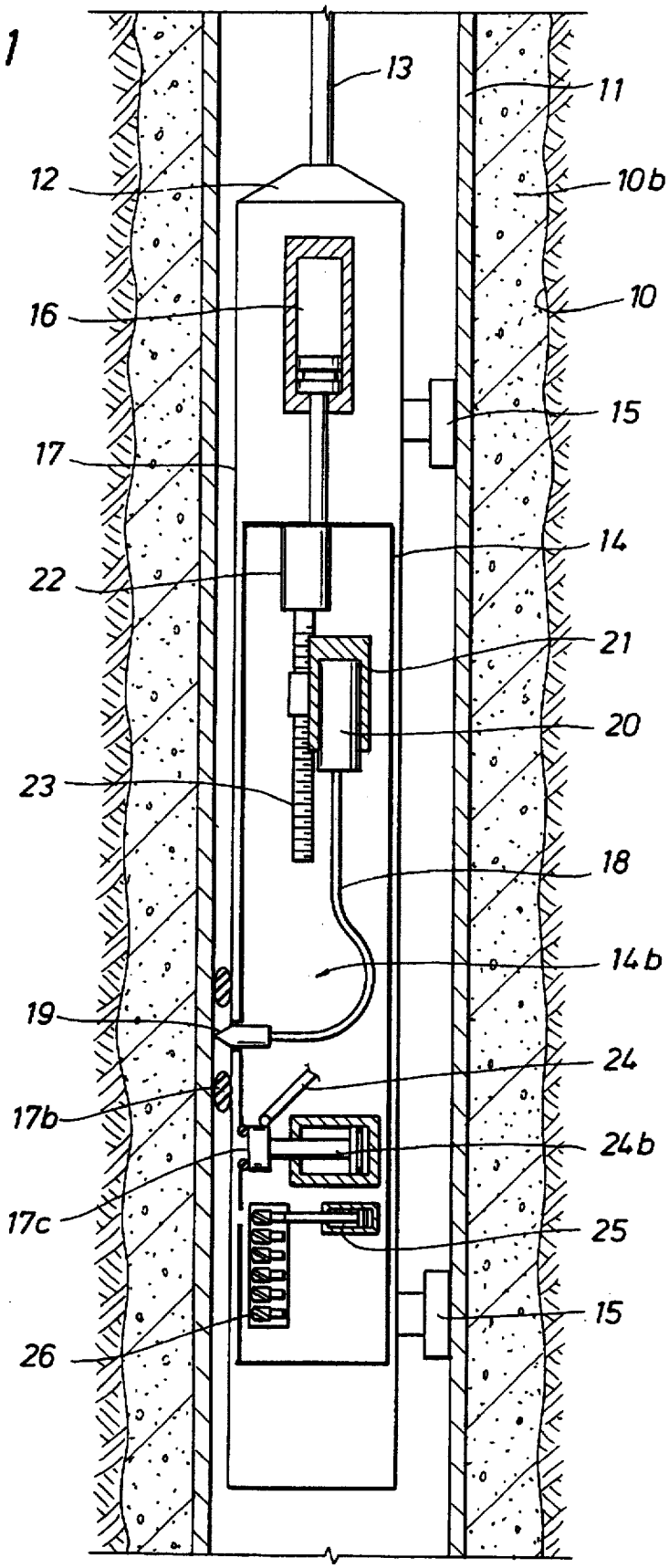
FIG. 1 is a schematic diagram of an apparatus in accordance with the present invention and which can be used to practice the method of the invention.
Figure 2:
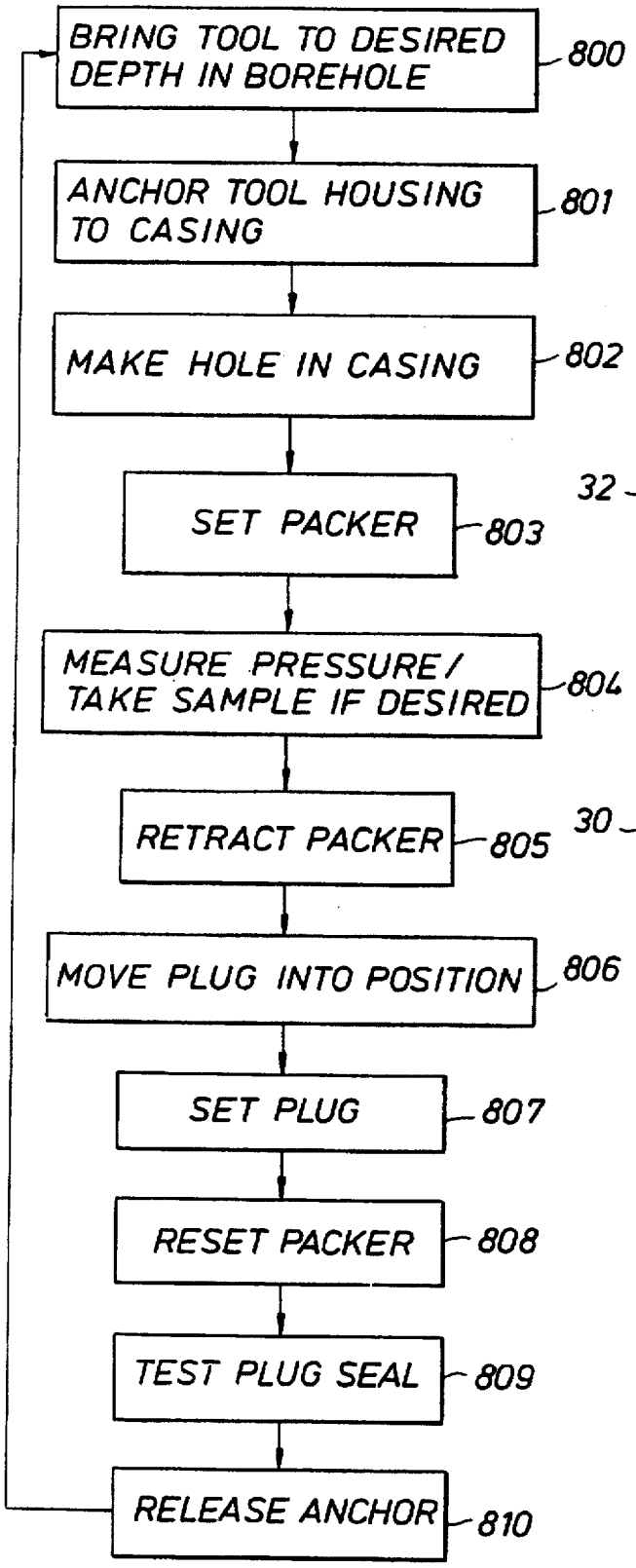
FIG. 2 is a flow diagram of a routine for controlling operation of embodiments of the invention.

FIG. 1 shows one embodiment of the invention and FIG. 2 illustrates the flow sequence of operations of the invention. The tool 12 is suspended on a cable 13, inside steel casing 11. This steel casing sheathes the borehole 10 and is supported with cement **10*b*. The borehole 10 is typically filled with a completion fluid or water. The cable length substantially determines the depths to which the tool 12 can be lowered into the borehole. Depth gauges can determine displacement of the cable over a support mechanism (sheave wheel) and determines the particular depth of the logging tool 12. The cable length is controlled by a suitable known means at the surface such as a drum and which mechanism (not shown). Depth may also be determined by electrical, nuclear or other sensors which correlate depth to previous measurements made in the well or to the well casing. Also, electronic circuitry (not shown) at the surface represents control communications and processing circuitry for the logging tool 12. The circuitry may be of known type and does not need to have novel features. The block 800 in FIG. 2 represents bringing the tool 12** to a specific depth level.

In the embodiment of FIG. 1, the tool 12 shown has a generally cylindrical body 17 which encloses an inner housing 14 and electronics. Anchor pistons 15 force the tool-packer **17*b* against the casing 11 forming a pressure-tight seal between the tool and the casing and serving to keep the tool stationary block 801**.

The inner housing 14 contains the perforating means, testing and sampling means and the plugging means. This inner housing is moved along the tool axis (vertically) by the housing translation piston 16. This movement positions, in succession, the components of each of these three systems over the same point on the casing.

A flexible shaft 18 is located inside the inner housing and conveyed through guide plates **14*b* (also see FIG. 5) which are integral parts of this inner housing. A drill bit 19 is rotated via the flexible shaft 18 by the drive motor 20. This motor is held in the inner housing by a motor bracket 21, which is itself attached to a translation motor 22. The translation motor moves the inner housing by turning a threaded shaft 23 inside a mating nut in the motor bracket 21. The flex shaft translation motor provides a downward force on the flex shaft during drilling, thus controlling the penetration. This drilling system allows holes to be drilled which are substantially deeper than the tool diameter. This drilling operation is shown in block 802**.

Figure 3:
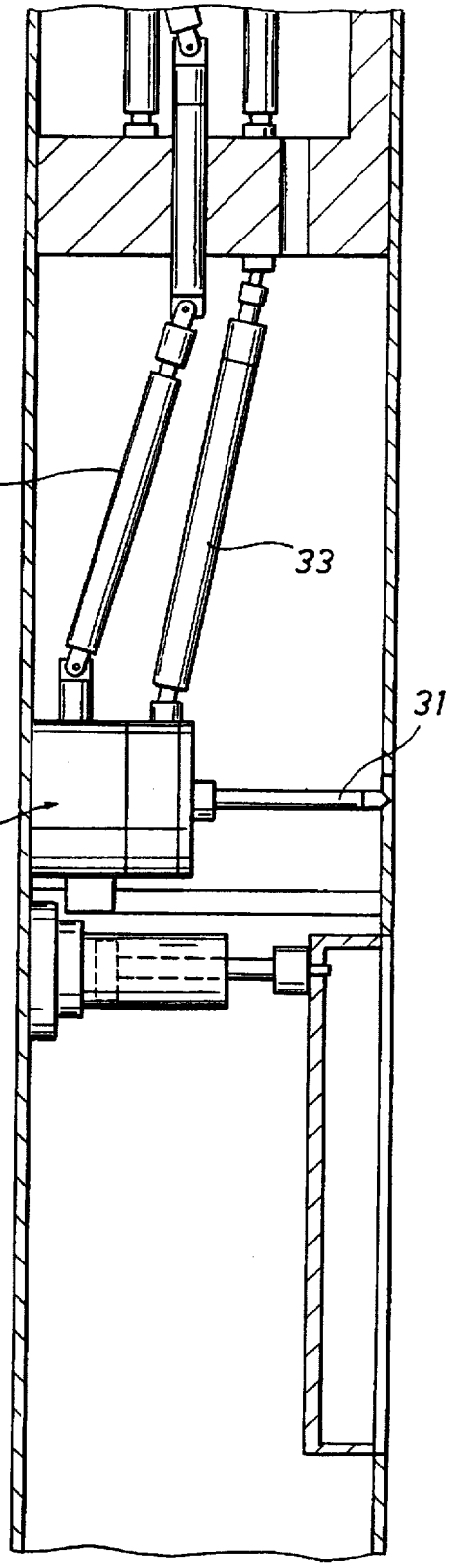
FIG. 3 (PRIOR ART)
FIG. 3 a view of a conventional drill bit system for creating a perforation and plugging the perforation.

Technology does exist that can produce perforations of a depth somewhat less than the diameter of the tool. One of these methods is shown in FIG. 3. In this approach the drill bit 31 is fitted directly to a right-angle gearbox 30, both of which are packaged perpendicular to the axis of the tool body. As shown, the gearbox 30 and drill bit 31 must fit inside the borehole. In this FIG. 2, the length of a drill bit is limited because the gearbox occupies approximately one-half the diameter of the borehole. This system also contains a drive shaft 32 and a flowline 33.

For the purpose of taking measurements and samples, a measurement-packer 17*c* and flow line 24 are also contained in the inner housing. After a hole has been drilled, the housing translation piston 16 shifts the inner housing 14 to move the measurement-packer into position over the drilled hole. The measurement packer setting piston 24*b* then pushes the measurement packer 17*c* against the casing thereby forming a sealed conduit between the drilled hole and flowline 24 as shown in block 803. The formation pressure can then be measured and a fluid sample acquired, if that is desired 804. At this point, the measurement-packer is retracted 805.

Finally, a plug magazine 26 is also contained in the inner housing 14. After formation pressure has been measured and samples taken, the housing translation piston 16 shifts the inner housing 14 to move the plug magazine 26 into position over the drilled hole 806. A plug setting piston 25 then forces one plug from the magazine into the casing, thus resealing the drilled hole 807. The integrity of the plug seal may be tested by once again moving the inner housing so as to re-position the measurement-packer over the plug, then actuating this packer hole 808 and monitoring pressure through the flowline while a "drawdown" piston is actuated dropping and remaining constant at this reduced value. A plug leak will be indicated by a return of the pressure to the flowline pressure found after actuating the drawdown piston. It should be noted that this same testing method can be used to verify the integrity of the tool-packer seal before drilling commences. However, for this test the measurement-packer is not set against the casing, thus allowing the drawdown to be supported by the tool-packer. The sequence of events is completed by releasing the tool anchors 810. The tool is then ready to repeat the sequence starting with block 800.

DETAILED DESCRIPTION OF THE INVENTION

Flexible Shaft

Figure 4A:
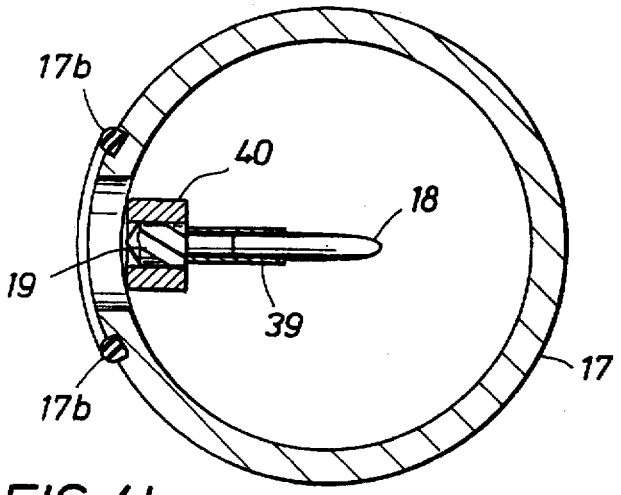
FIG. 4*a* is a diametrical tool section of a flexible drilling shaft in accordance with the present invention.
Figure 4B:
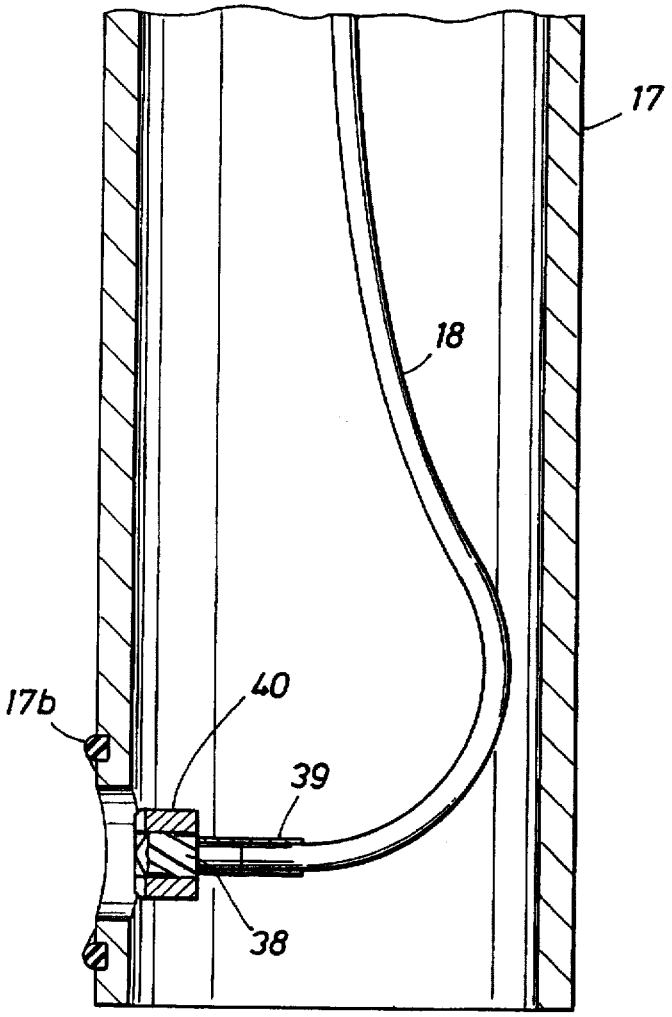
FIG. 4*b* is a longitudinal tool section of a flexible drilling shaft in accordance with the present invention.
Figure 5:
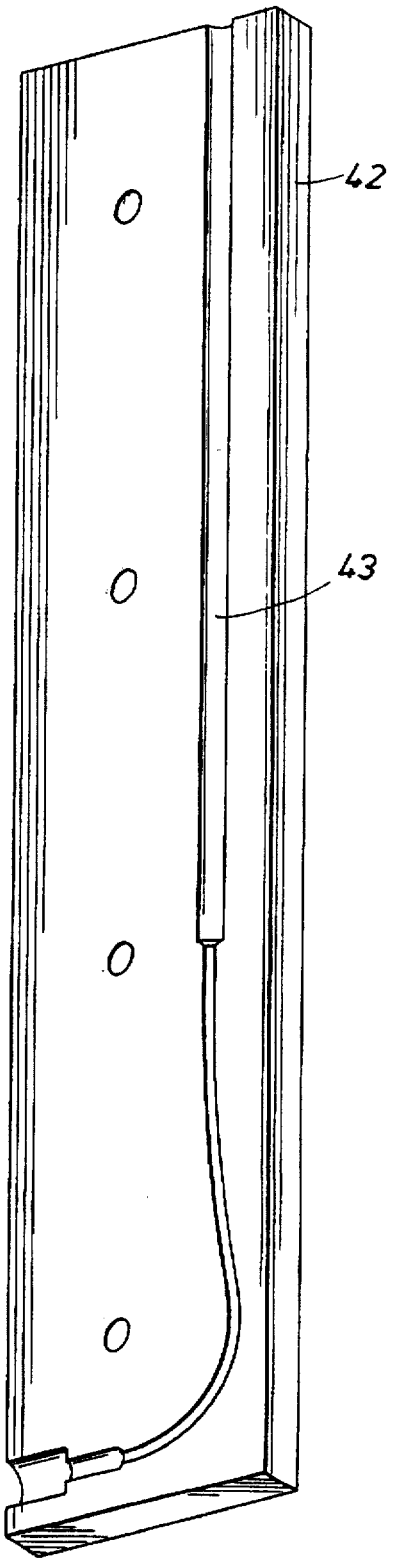
FIG. 5 is one of a pair of mating guide plates.

The flexible drilling shaft is shown in detail in FIGS. 4*a* and 4*b* and one of the pair of flexshaft guide plates is shown detailed in FIG. 5. In FIG. 4*a*, a diametrical tool cross-section view, shows the flexshaft and drill bit in the tool body 17. The drill bit 19 is connected to the flex-shaft 18 by a coupling 39. The coupling can be swaged onto the flex shaft. Guide bushings 40 enclose and hold the drill bit to keep the drill bit straight and in place. FIG. 4*b* is a longitudinal tool section that shows the advantage of a flexshaft over conventional technology. FIG. 5 shows one of the two mating guide plates 42 which form the "J" shaped conduit 43 through which flexshaft is conveyed.

The flexshaft is a well known machine element for conveying torque around a bend. It is generally constructed by helically winding, in opposite directions, successive layers of wire over a straight central mandrel wire. The flex shaft properties are tailored to the specific application by varying the number of wires in each layer, the number of layers, the wire diameter and the wire material. In this particular application the shaft must be optimized for fatigue life (number of revolutions), minimum bend radius (to allow packaging in the given tool diameter) and for conveying thrust.

Another concern is the shaft reliability when applying thrust to the drill bit through the shaft. During drilling operations various amounts of thrust are applied to the drill bit to facilitate drilling. The amount of thrust applied depends on the sharpness of the bit and the material being drilled. Sharper bits only require the application of minimum thrust through the flexible shaft. This minimum thrust has virtually no affect on the reliability of the flexible shaft. Duller bits require the application of more thrust that could damage the flexible shaft. One solution is to apply the thrust directly to the drill bit instead of through the flexible shaft. In this method, force applied to a piston located in the tool is transferred by the piston to the drill bit. The thrust necessary for drilling is supplied without any effect on the flexible shaft. This technique is further described in a U.S. patent application Ser. No. 08/603,307, docket number 20.2650 filed concurrently with the present application. A second solution is to use a sharp bit each time a drilling operation occurs. Multiple bits can be stored in the tool and a new bit used for each drilling procedure. As previously stated, the amount of thrust required by sharper bits has minimal affect on the flexible shaft. This technique is further described in a U.S. patent application Ser. No. 08/602,485, docket number 20.2651 filed concurrently with the present application.

Guideplates

When the flexshaft is used to convey both torque and thrust, as it is in this application, some means must be provided to support the shaft to prevent it from buckling from the thrust loading applied through the flexshaft to the drill bit. In this embodiment of the invention, this support is provided by the mating pair of guide plates FIG. 5. These plates form the "J" shaped conduit through which the flexshaft passes. Forming this geometry from a pair of plates is a practical means of fabrication and an aid in assembly, but is not strictly necessary for functionality. A "J" shaped tube could serve the same function. The inner diameter formed from the pair of plates is only slightly larger than the diameter of the flexshaft. This close fit minimizes the helical windup of the flexshaft in high torque drilling situations and it also maximizes the efficiency with which torque can be conveyed from the drive to the drill bit. The guideplate material is chosen for compatibility with the flexshaft. A lubricant can be used between the flexshaft and the guideplates.

Drillbit

The drillbit used in this invention requires several traits. It must be tough enough to drill steel without fracturing the sharp cutting edge. It must be simultaneously hard enough to drill abrasive formations without undo dulling. It must have a tip geometry giving torque and thrust characteristics which match the capabilities of the flexible drive shaft. It must have a fluting capable of moving drill cuttings out of a hole many drill-diameters deep. The drill must be capable of drilling a hole sufficiently straight, round and not oversized so that the metal plug can seal it.

Plugging Mechanism

The plugging mechanism is shown in FIGS. 6*a*, 6*b* and 6*c*. This plugging technique has a similar plugging concept to that of U.S. Pat. No. 5,195,588, however, the plug is different. The plug is composed of two components: a tubular socket 76 and a tapered plug 77. The tubular socket 76 has a closed front end, a lip 78 at its rear and grooves 79 in its center. The tapered plug 77 is inserted in the opened end of the socket component 76. The lip 78 serves to hold the socket and prevent it from going past the casing wall when force is applied to the tapered plug component while it is inserted into the socket.

Setting the plug is a two stage process. As the piston moves forward the socket component 76 is forced into the socket component as shown in FIG. 6c. The tapered nature of component 77, forces the socket 76 to radially expand thus creating a tight seal between the socket and casing surface. The grooves 79 also help form a seal, and prevent the plug from blowing out. The presence of more than one groove permits the socket to more readily conform to the periphery of an irregular perforation in the casing 11 while still ensuring a good seal.

Figure 7:
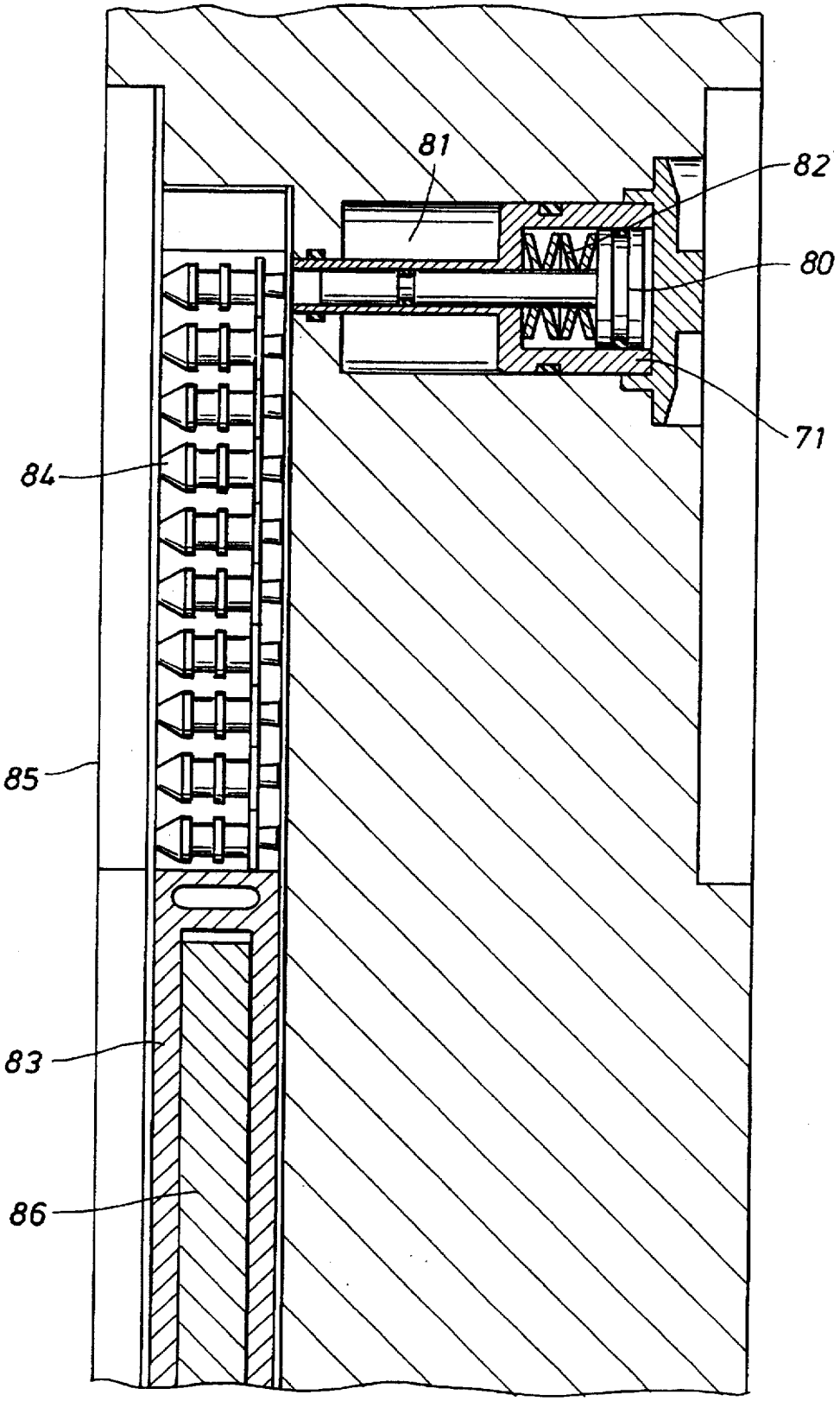
FIG. 7 is a side view of the mechanical plugger and plug magazine.

FIG. 7 shows the mechanical plugger that inserts a plug into a perforation. The plugger contains a two stage setting piston (outer piston 71 and inner piston 80). During the plugging process, as force is applied to both pistons, 71 and 80, the entire piston assembly moves a distance through space 81 forcing the plug assembly 76 and 77 into the perforation. When the lip portion 78 of the socket component 76 reaches the casing, the movement of the outer piston 71 stops. The continued application of hydraulic pressure upon the piston assembly causes the inner piston to overcome the force of the springs 82. Thus, the inner piston 80 continues to move forcing the tapered plug 77 into the socket 76.

FIG. 7 also shows the magazine 85 that stores multiple plugs 84 and feeds them during the plugging process. After a plug is inserted into a perforation, and the piston assembly 71 and 80 is fully retracted, another plug is forced upward and into position to be inserted into the next perforation that is to be plugged. This upward move is induced by the force from the pusher assembly 83. This force can be generated by a spring 86 or fluid.

The method and apparatus of the present invention provides a significant advantage over the prior art. The invention has been described in connection with the preferred embodiments. However, the invention is not limited thereto. Changes, variations and modifications to the basic design may be made without departing from the inventive concept in this invention. In addition, these changes, variations modifications would be obvious to those skilled in the art having the benefit of the foregoing teachings contained in this application. All such changes, variations and modifications are intended to be within the scope of the invention which is limited by the following claims.

We claim:

1. An apparatus for sampling an earth formation at extended formation depths from a cased borehole environment, comprising:

a means for creating a perforation in said casing, said perforating means being capable of extending said perforation into said formation at depths greater than the diameter of said borehole;

a plugging means for plugging said perforation by inserting a plug of solid material into said perforation;

a means for hydraulic testing and sampling said formation at said extended formation depths via said perforation; and a housing moveable through the casing and in which said perforating means, plugging and testing means are mounted.

2. The apparatus of claim 1 wherein said housing is mounted on a wireline that can be raised and lowered in a borehole.

3. The apparatus of claim 2 further comprising a means for moving said perforating means in said borehole to a position opposite a location for a perforation of said casing and formation.

4. The apparatus of claim 3 wherein said moving means comprises a means for effecting mechanical movement of said perforating means with respect to said housing while said housing is set at a substantially fixed location.

5. The apparatus of claim 3 wherein said moving means is attached to a moveable inner housing that is contained in said housing, said inner housing containing said perforating means and is moveable with respect to said housing.

6. The apparatus of claim 1 further comprising a means in said housing for securing said housing at a substantially fixed location in said borehole and further comprising a means for actuating said perforating means and a means for actuating said plugging means while said housing is set at a substantially fixed location.

7. The apparatus of claim 1 wherein said perforating means comprises a drilling means, an actuating means for drilling and a flexible means for connecting the drilling and actuating means, said flexible means enabling said perforation to extend into said formation at depths greater than the borehole diameter.

8. The apparatus of claim 7 wherein said flexible means is a flexible shaft.

9. The apparatus of claim 8 wherein said flexible shaft is a cable.

10. The apparatus of claim 7 further comprising a means for applying force through said flexible connecting means to said drilling means.

11. The apparatus of claim 10 wherein said force means is a translational motor.

12. The apparatus of claim 7 further comprising a means to guide said flexible means such that said drilling means is properly aligned to drill said perforation in said casing.

13. The apparatus of claim 12 wherein said guide means is a solid member, said solid member containing a groove such that said flexible connecting means passes through said groove in said guide means member whereby said flexible connecting means is shaped and guided during the perforating process.

14. An apparatus for sampling an earth formation at extended formation depths from a cased borehole environment, comprising:

a non-explosive means for creating a perforation in said casing and capable of extending said perforation into said formation at depths greater than the diameter of said borehole;

a means for hydraulic testing and sampling said formation at said extended formation depths via said perforation; and a housing moveable through the casing and in which said perforating means and said testing means are mounted.

15. The apparatus of claim 14 further comprising a means for moving said perforating means in said borehole to a position opposite a location for a perforation of said casing and formation.

16. The apparatus of claim 15 wherein said moving means comprises a means for effecting mechanical movement of said perforating means with respect to said housing while said housing is set at a substantially fixed location.

17. The apparatus of claim 15 wherein said moving means is attached to a moveable inner housing, said inner housing containing said perforating means and is moveable with respect to said housing.

18. The apparatus of claim 14 further comprising a means in said housing for setting said housing at a substantially fixed location in said borehole and further comprising a means for actuating said perforating means while said housing is set at a substantially fixed location.

19. The apparatus of claim 14 wherein said perforating means comprises a drilling means, an actuating means for drilling and a flexible means for connecting the drilling and actuating means, said flexible means enabling said perforation to extend into said formation at depths greater than the borehole diameter.

20. The apparatus of claim 19 wherein said flexible means is a flexible shaft.

21. The apparatus of claim 20 wherein said flexible shaft is a cable.

22. The apparatus of claim 19 further comprising a means for applying force through said flexible connecting means to said drilling means.

23. The apparatus of claim 22 wherein said force means is a translational motor.

24. The apparatus of claim 19 further comprising a means to guide said flexible means such that said drilling means is properly aligned to drill said perforation in said casing.

25. The apparatus of claim 24 wherein said guide means is a solid member, said solid member containing a groove such that said flexible connecting means passes through said groove in said guide means member whereby said flexible connecting means is shaped and guided during the perforating process.

26. A method for sampling an earth formation at extended formation depths from a cased borehole traversing said formation, comprising the steps of:

moving a device to a position in a region of said borehole;

setting said device at said position in the borehole;

perforating said casing and formation, without employing explosives, such that a perforation is created, said perforation extending into said formation to depths greater than the diameter of said borehole;

establishing fluid communication between said device and said perforation while said device is set at said position; and obtaining a formation fluid sample through said perforation.

27. The method of claim 26 wherein said perforating step further comprises using a flexible shaft to to extend said perforation into said formation at depths greater than the borehole diameter.

28. The method of claim 27 further comprising the step of inserting a plug of solid material into said perforation.

* * * * *